US009404688B2

(12) United States Patent
Gaeta et al.

(10) Patent No.: US 9,404,688 B2
(45) Date of Patent: Aug. 2, 2016

(54) COOLING TOWER NOZZLE AND METHODS OF ASSEMBLY

(71) Applicant: AMERTECH TOWERSERVICES, LLC, Shrewsbury, NJ (US)

(72) Inventors: Mark A. Gaeta, Lincroft, NJ (US); Art Weber, Readington, NJ (US); Jason Weber, West Amwell, NJ (US); Alan Tweedle, Garwood, NJ (US); William Weber, Point Pleasant, NJ (US)

(73) Assignee: AMERTECH TOWERSERVICES, LLC, Shrewsbury, NJ (US)

( * ) Notice: Subject to any disclaimer, the term of this patent is extended or adjusted under 35 U.S.C. 154(b) by 180 days.

(21) Appl. No.: 14/448,054

(22) Filed: Jul. 31, 2014

(65) Prior Publication Data

US 2015/0048527 A1 Feb. 19, 2015

Related U.S. Application Data

(60) Provisional application No. 61/865,305, filed on Aug. 13, 2013.

(51) Int. Cl.

| | |
|---|---|
| ***B05B 1/26*** | (2006.01) |
| ***F28F 25/08*** | (2006.01) |
| ***B01F 3/04*** | (2006.01) |
| ***F28C 1/02*** | (2006.01) |

(52) U.S. Cl.

CPC ..... *F28C 1/02* (2013.01); *B01F 3/04049* (2013.01); *B05B 1/26* (2013.01); *F28F 25/08* (2013.01); *Y10T 29/49826* (2015.01); *Y10T 29/49963* (2015.01)

(58) Field of Classification Search

CPC ..... B05B 1/26; F28F 25/02; F28F 25/08; B01F 3/04; B01F 3/04007; B01F 3/04021; B01F 3/04049; F28C 1/02; F28C 1/00

USPC ..... 261/76, 108, 110, 111, DIG. 11; 239/500

See application file for complete search history.

(56) References Cited

U.S. PATENT DOCUMENTS 4,350,302 A * 9/1982 Gruber ..... B05B 1/265 239/500

* cited by examiner

*Primary Examiner* — Robert A Hopkins

(74) *Attorney, Agent, or Firm* — Moser Taboada; Alan Taboada

(57) ABSTRACT

Cooling tower nozzle assemblies and methods of assembly are provided herein. In some embodiments, a cooling tower nozzle assembly includes a body having an opening extending through the body from a first end to a second end; a support arm extending from the body and comprising a disk disposed on a first portion of the support arm opposite the first end of the body; a splash plate coupled to the disk, the splash plate having a bottom surface including a plurality of legs extending away from the bottom surface, wherein the plurality of legs have radially inwardly facing portions spaced a first distance from a central axis of the splash plate and aligned with the disk, and wherein the plurality of legs include features to interconnect to the disk; and a screw disposed through the splash plate to couple the splash plate to the support arm.

20 Claims, 3 Drawing Sheets

COOLING TOWER NOZZLE AND METHODS OF ASSEMBLY

CROSS-REFERENCE TO RELATED APPLICATIONS

This application claims benefit of U.S. provisional patent application Ser. No. 61/865,305, filed Aug. 13, 2013, which is herein incorporated by reference in its entirety.

FIELD

Embodiments of the present invention generally relate to nozzles for use in cooling towers.

BACKGROUND

Cooling towers are used for cooling a liquid, for example water, used in a manufacturing plant, such as a power generation station, to cool equipment being operated within the facility. Normally, a cooling tower includes a region where liquid falling through the region can contact air passing through the region. By contact of the air and liquid, a portion of the liquid evaporates, thereby cooling the remaining liquid. In order to effect intimate contact between the liquid to be cooled and the air in the cooling tower and thereby increase the amount of cooling, nozzles are typically used to distribute the liquid into droplets prior to contacting the air.

Some nozzles use a splash plate disposed opposite a nozzle orifice to enhance distribution of the liquid to be cooled. The splash plate is a separate component that snaps on to a support arm in position opposite the nozzle orifice. However, the inventors have noticed that due to the force of the liquid impinging upon the splash plate, the splash plate often becomes partially or wholly disconnected from the support arm, thereby greatly negatively impacting cooling efficiency.

Thus, the inventors have provided improved cooling tower nozzles.

SUMMARY

Cooling tower nozzle assemblies and methods of assembly are provided herein. Embodiments of the present invention relate to cooling tower nozzles used, for example, in counterflow cooling towers. Embodiments of the present invention include cooling tower nozzles having a nozzle body and a splash plate that is more securely coupled to the nozzle body to prevent or minimize detachment or misalignment of the splash plate. Embodiments of the present invention may also include features that facilitate ease of assembly while providing enhanced coupling between the splash plate and the nozzle body.

In some embodiments, a cooling tower nozzle assembly includes a body having an opening extending through the body from a first end to a second end; a support arm extending from the body and comprising a disk disposed on a first portion of the support arm opposite the first end of the body; a splash plate coupled to the disk, the splash plate having a bottom surface including a plurality of legs extending away from the bottom surface, wherein the plurality of legs have radially inwardly facing portions spaced a first distance from a central axis of the splash plate and aligned with the disk, and wherein the plurality of legs include features to interconnect to the disk; and a screw disposed through the splash plate to couple the splash plate to the support arm.

In some embodiments, a cooling tower nozzle assembly includes a body having an opening extending through the body; a nozzle insert disposed in the opening at a first end of the body, the nozzle insert including a nozzle orifice; a support arm extending from the body, the support arm comprising a disk disposed on a portion of the support arm opposite the nozzle orifice; and a splash plate coupled to the support arm. The splash plate may include a bottom surface including a plurality of legs extending away from the bottom surface, the legs comprising radially inwardly facing portions spaced a first distance from a central axis of the splash plate, wherein the radially inwardly facing portions of the legs comprise a radial recess having a first radius and a first height, wherein the disk has a second radius and a second height, and wherein the second radius is less than the first radius and the second height is less than the first height such that the disk is retained within the recess; and a portion extending from the bottom surface sized to abut a top surface of the disk. The disk may include a plurality of first portions having a radius to allow at least the radially inwardly facing portions of the plurality of legs to pass through the plurality of first portions without interference; a plurality of second portions extending radially outward from the plurality of first portions beyond the first radius; and a plurality of third portions having a radius less than the first radius and greater than the first distance.

In some embodiments, a method of assembling a cooling tower nozzle assembly includes providing a body having an opening extending through the body and a support arm extending from the body to support a disk in a position opposite the opening of the body; providing a splash plate having a bottom surface including a plurality of legs extending away from the bottom surface, wherein the legs have radially inwardly facing portions spaced a first distance from a central axis of the splash plate and a plurality of radial recesses formed in the radially inwardly facing portions of the legs, wherein the plurality of radial recesses having a first radius; aligning the plurality of legs with a plurality of first portions of the disk that have a radius that is less than the first distance; bringing the splash plate and the disk together such that the plurality of legs pass through the plurality of first portions until the radial recesses are aligned with the disk; rotating the splash plate with respect to the disk to engage a plurality of second portions of the disk with the plurality of legs, wherein each of the plurality of second portions have a radius that is greater than the first radius; and continuing to rotate the splash plate with respect to the disk such that respective third portions of the disk are disposed within radial recesses of the plurality of legs, wherein the third portions each have a radius that is less than the first radius and greater than the first distance.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
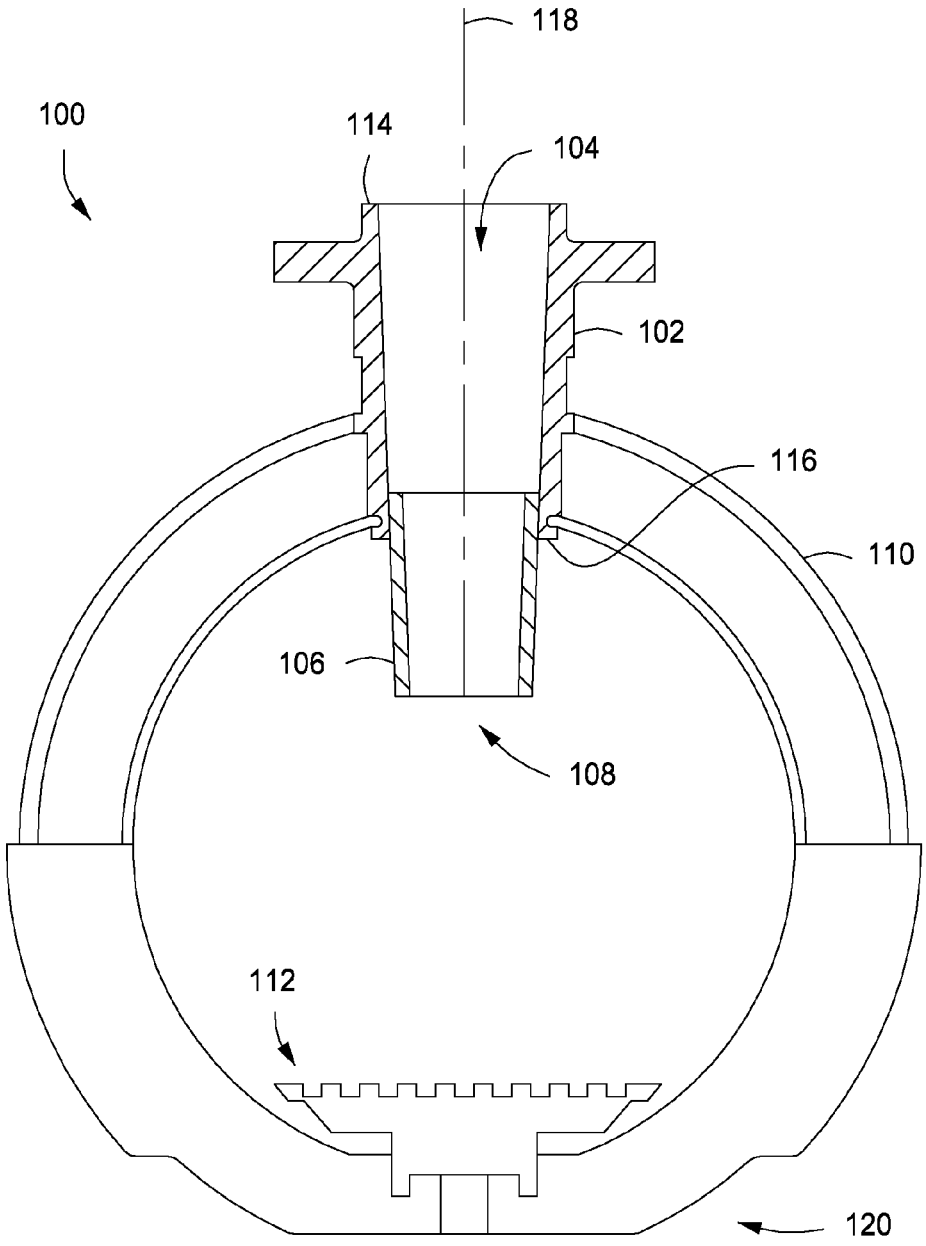
FIG. 1 is a side view of a cooling tower nozzle assembly in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present invention provide cooling tower nozzles used, for example, in counterflow cooling towers. The nozzle is designed to provide a non-clogging nozzle with large overlapping spray pattern and increased efficiency. Properly functioning cooling tower nozzles advantageously provide for optimum efficiency in a cooling tower. Nozzles that are not functioning properly can drastically reduce cooling tower efficiency, which can result in a loss of megawatts to the power grid and a great waste of efficiency, water, electricity, and fuel.

The main problem with some conventional nozzle designs is that the splash plate detaches from the nozzle body. When the splash plate detaches from the nozzle body it defeats the primary functionality of the nozzle. The liquid needs to leave the nozzle orifice and hit the splash plate to properly distribute to efficiently cool the liquid. Embodiments of the present invention retain the splash plate more securely to the nozzle body to prevent or minimize detachment or misalignment of the splash plate.

FIG. 1 is a side view of a cooling tower nozzle assembly 100 in accordance with some embodiments of the present invention. The cooling tower nozzle assembly 100 generally includes a body 102 having an opening 104 extending through the body 102 from a first end 116 to a second end 114 and a nozzle insert 106 disposed at the first end 116 of the opening 104. The second end 114 of the opening 104 is adapted to be coupled to a source (not shown) of liquid to be cooled. The nozzle insert 106 includes a nozzle orifice 108 to facilitate spraying the liquid as it passes through the opening 104 of the body 102 and the nozzle insert 106. Alternatively, the nozzle orifice 108 may be provided by the opening 104 without the nozzle insert 106. The support arm 110 extends from the body 102 and is part of, or coupled to, the body 102 to support a splash plate 112 in a position opposite the nozzle orifice 108 and aligned with an axis 118 of the opening 104. The splash plate 112 is a separate component that is securely coupled to the support arm 110. The splash plate 112 functions to disperse the stream of liquid provided through the nozzle orifice 108 to enhance the efficiency of cooling of the liquid.

Figures 2, 2A:
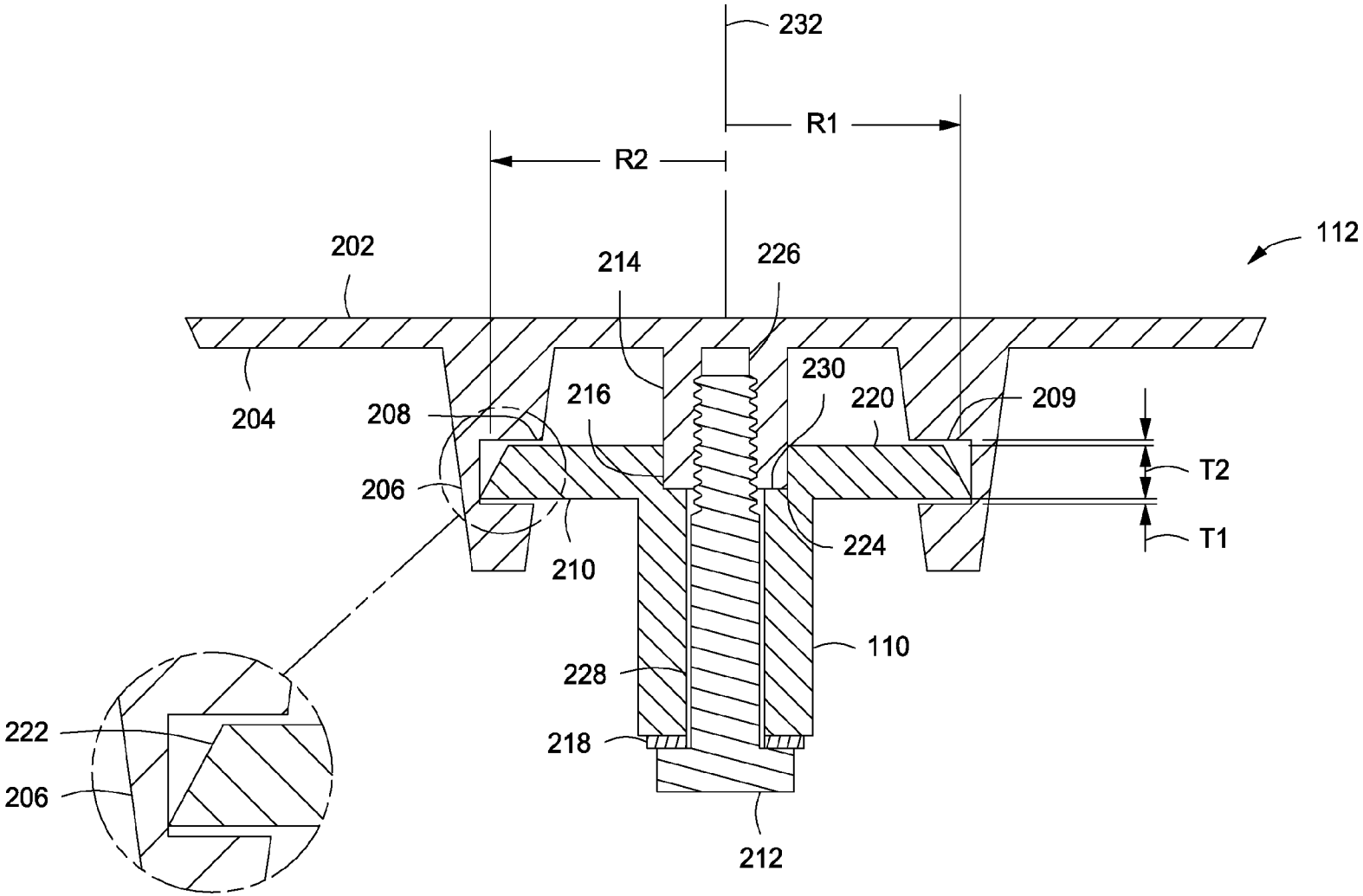
FIG. 2 is a side cross-sectional view of a portion of a cooling tower nozzle assembly in accordance with some embodiments of the present invention.
FIG. 2A is a side cross-sectional view of a portion of a cooling tower nozzle assembly in accordance with some embodiments of the present invention.

The splash plate 112 may be coupled to the support arm 110 in one or more of a variety of ways. For example, as depicted in FIG. 2, the splash plate 112 includes a top surface 202 and an opposing bottom surface 204 having a plurality of legs 206 extending away from the bottom surface 204. A plurality of features 208 are provided in the legs 206 to facilitate interconnection with the support arm 110. For example, the support arm 110 may include a disk 210 configured to interface with the features 208. The disk 210 may be disposed on a first portion 120 of the support arm 110 opposite the first end 116 of the body 102. The features 208 may include a groove or radial recess 209 formed in a radially inwardly facing portion of at least some of the legs 206. The radial recess 209 has a first radius R1 measured from a central axis 232 (which may be collinear with the axis 118) and a first height T1. The disk 210 has a second radius R2 measured from the central axis 232 and a second height T2 sized to be press fit and retained within the radial recess 209 of the legs 206. The second height T2 may be chosen to be less than the first height T1 such that the disk fits within the radial recess 209. The second height T2 may be chosen to be less than, but close to, the first height T1 such that the disk fits snugly within the radial recess 209 to minimize play between the disk 210 and the splash plate 112. In some embodiments, the second radius R2 may be slightly greater than the first radius R1 such that the disk is retained within the radial recess 209 by force of the plurality of legs 206. In some embodiments, the second radius R2 may be less than the first radius R1. In some embodiments, as depicted in FIG. 2A, the disk 210 may include a slanted outer wall 222 to facilitate placing the disk 210 in position within the radial recesses 209 of the legs 206.

In some embodiments, a portion 214 of the splash plate 112 extends from the bottom surface 204 to advantageously provide a bearing surface 224 to support the splash plate 112 against forces of liquid impinging upon the top surface 202 of the splash plate 112 during use. The bearing surface 224 may abut and be supported by a top surface 220 of the disk 210. In some embodiments, the portion 214 extends into a corresponding recess 216 formed in the disk 210 such that the bearing surface 224 abuts and is supported by a surface 230 of the recess 216. In some embodiments, a centrally located opening 226 may be provided at least partially through the portion 214.

In some embodiments, a threaded fastener, for example, a screw 212, may be provided through an opening, passage 228, in the support arm 110 that extends through the thickness, (for example first thickness T1) of the disk 210 to fasten the support arm 110 to the portion 214 of the splash plate 112. The screw 212 may extend into and engage a wall of the opening 226. In some embodiments, the screw 212 may be a self-tapping screw. In some embodiments, a washer 218 may be provided between the head of the screw 212 and the support arm 110 to distribute the load developed by securing the splash plate 112 to the support arm 110 with the screw 212.

In some embodiments, the portion 214 of the splash plate 112 may advantageously provide extra material for the threads of the screw 212 to bite into to more securely couple the splash plate 112 to the support arm 110 (as compared to fastening the splash plate 112 without the portion 214). In some embodiments, the portion 214 of the splash plate 112 may abut a top surface 220 of the disk 210 when the splash plate 112 is secured to the support arm 110 with the screw 212.

In some embodiments, the portion 214 of the splash plate 112 may extend into the corresponding recess 216 formed in the disk 210 to provide additional surface area for the threads of the screw 212 to more securely retain the splash plate 112 and withstand forces of liquid impinging upon the top surface 202 of the splash plate 112 during use. In addition, providing the splash plate 112 with a portion 214 that extends into the recess in the disk 210 further advantageously facilitates guidance and alignment of the components during assembly.

in some embodiments, the screw may facilitate securing the splash plate 112 to the support arm 110 as described above without other securing elements, such as the legs 206 and the plurality of features 208. The screw may also be used with the legs 206 and the plurality of features 208, or with other securing elements or features.

Figure 3:
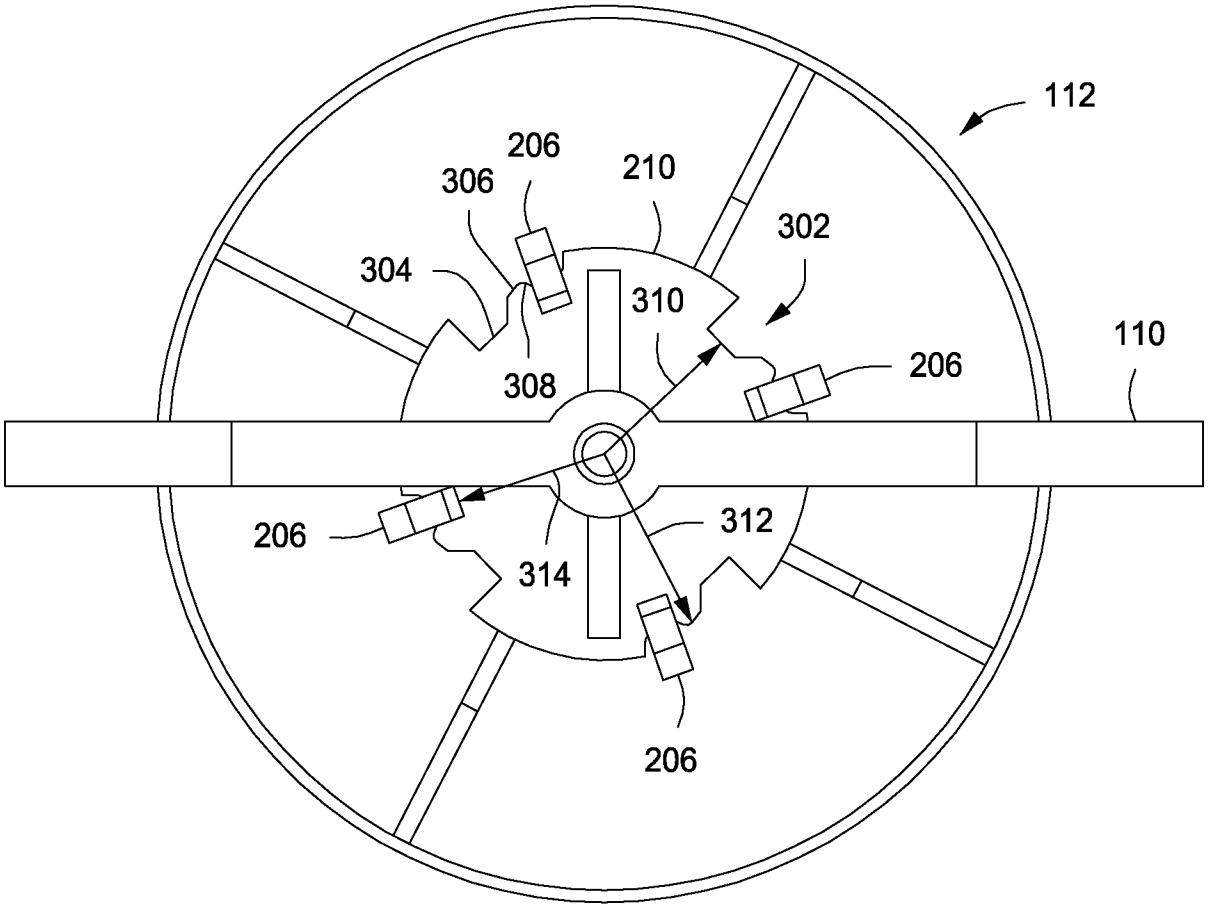
FIG. 3 is a bottom view of a cooling tower nozzle assembly in accordance with some embodiments of the present invention.

In some embodiments, as shown in FIG. 3, the disk 210 may include one or more features to facilitate ease of installation or assembly of the splash plate 112 to the support arm 110 while providing a more secure coupling (e.g., lock and fit) between the splash plate 112 and the support arm 110. For example, the disk 210 in FIG. 3 has a plurality features 302 where each feature 302 includes a first portion 304 spaced from a central axis 232 a radial distance 310 and sized to allow the legs 206 of the splash plate 112 to pass through the first portion 304 without interference during assembly. A second portion 306 of the feature 302 extends radially outward from the first portion 304 (and from the central axis 232 a radial distance 312) at least beyond the radial distance R1 of the corresponding radial recess 209 of the feature 208 of the legs 206. A third portion 308 of the feature 302 extends radially outward from the central axis 232 of the disk a radial distance 314, which is less than the radial distance 312, to provide additional clearance between the feature 208 of the legs 206 and the disk 210.

To assemble the splash plate 112 to the support arm 110 the legs 206 may first be aligned with the first portion 304 of the features 302 of the disk 210, and the support arm 110 and splash plate 112 may be brought together with the legs 206 passing through the first portions 304 until the features 208 of the legs 206 are aligned with the disk 210. The splash plate 112 may then easily be rotated to engage the second portions 306 with the legs 206 and to pass the second portions 306 through the features 208 so that the third portions 308 are disposed in the features 208. In this position, the legs 206 are aligned with the third portions 308 and the second portion 306 serves to hold the splash plate 112 in place and prevent rotation back to the assembly/disassembly position (e.g., where the legs 206 of the splash plate 112 are aligned with the first portions 304). As forces applied by the liquid impinging upon the splash plate 112 are predominantly normal to the top surface 202 of the splash plate 112, minimal rotational forces are developed on the splash plate 112. Thus, minimal forces exist during use that would cause the splash plate 112 to rotate beyond the second portion 306 to the first portion 304 where the splash plate 112 could easily be removed from the support arm 110. In addition, in some embodiments, the third portions 308 are sized to be spaced apart from the extreme edges of the features 208 of the legs 206, thereby advantageously allowing the splash plate 112 to be retained within the feature 208 with minimal forces on the legs 206 that could undesirably lead to failure of the legs 206 and decoupling of the splash plate 112.

The foregoing embodiments may be combined or provided separately. For example the splash plate may be coupled to the support arm using just the screw. In some embodiments, the splash plate may include a portion extending from the back surface of the splash plate to provide additional splash plate material for the screw to mate with. In some embodiments, the portion extending from the back surface of the splash plate may be provided in combination with a corresponding recess in the disk that mates with the extending portion to provide additional material for the screw to bite into as well as to guide and align the mating of the splash plate and the support arm. In some embodiments the rotating locking design shown in FIG. 3 may be used alone or in combination with the screw and/or the collar as shown in FIG. 2.

While the foregoing is directed to embodiments of the present invention, other and further embodiments of the invention may be devised without departing from the basic scope thereof.

The invention claimed is:

1. A cooling tower nozzle assembly, comprising:

a body having an opening extending through the body from a first end to a second end;

a support arm extending from the body and comprising a disk disposed on a first portion of the support arm opposite the first end of the body;

a splash plate coupled to the disk, the splash plate having a bottom surface including a plurality of legs extending away from the bottom surface, wherein the plurality of legs have radially inwardly facing portions spaced a first distance from a central axis of the splash plate and aligned with the disk, and wherein the plurality of legs include features to interconnect to the disk; and a screw disposed through the splash plate to couple the splash plate to the support arm.

2. The assembly of claim 1, further comprising:

a nozzle insert disposed in the opening at the first end of the body, the nozzle insert including a nozzle orifice.

3. The assembly of claim 1, wherein a radius of the disk cooperates with the radially inwardly facing portions of the plurality of legs to couple the splash plate to the support arm.

4. The assembly of claim 1, wherein at least some of the radially inwardly facing portions of the plurality of legs comprise a radial recess having a first radius and a first height, and the disk has a second radius and a second thickness, where the second radius is less than the first radius and the second thickness is less than the first height such that the disk is retained within the radial recess.

5. The assembly of claim 4, wherein the disk comprises:

a plurality of first portions having a radius to allow at least the radially inwardly facing portion of each of the plurality of legs to pass through the plurality of first portions without interference;

a plurality of second portions extending radially outward from the plurality of first portions beyond the first radius; and a plurality of third portions having a radius less than the first radius and greater than the first distance.

6. The assembly of claim 5, wherein the splash plate includes a portion extending from the bottom surface sized to abut a top surface of the disk.

7. The assembly of claim 6, wherein the top surface of the disk includes a recess into which the portion extends.

8. The assembly of claim 6, wherein the support arm includes a passage extending through the first portion and the disk such that the passage is aligned with the portion extending from the bottom surface of the splash plate.

9. The assembly of claim 8, wherein the screw is disposed within the passage to fasten the splash plate to the support arm.

10. The assembly of claim 9, wherein the top surface of the disk includes a recess into which the portion extends.

11. The assembly of claim 1, wherein a second portion of the support arm extends from the first portion and is coupled to the body.

12. The assembly of claim 1, wherein the splash plate includes a portion extending from the bottom surface sized to abut a top surface of the disk.

13. The assembly of claim 12, wherein the top surface of the disk includes a recess into which the portion extends.

14. The assembly of claim 12, wherein the support arm includes a passage extending through the first portion and the disk such that the passage is aligned with the portion extending from the bottom surface of the splash plate.

15. The assembly of claim 14, wherein the screw is disposed within the passage to fasten the splash plate to the support arm.

16. The assembly of claim 15, wherein the top surface of the disk includes a recess into which the portion extends.

17. A cooling tower nozzle assembly, comprising:

a body having an opening extending through the body;

a nozzle insert disposed in the opening at a first end of the body, the nozzle insert including a nozzle orifice;

a support arm extending from the body, the support arm comprising a disk disposed on a portion of the support arm opposite the nozzle orifice; and a splash plate coupled to the support arm, the splash plate comprising:

a bottom surface including a plurality of legs extending away from the bottom surface, the legs comprising radially inwardly facing portions spaced a first distance from a central axis of the splash plate, wherein the radially inwardly facing portions of the legs comprise a radial recess having a first radius and a first height, wherein the disk has a second radius and a second height, and wherein the second radius is less than the first radius and the second height is less than the first height such that the disk is retained within the recess; and a portion extending from the bottom surface sized to abut a top surface of the disk, wherein the disk comprises:

a plurality of first portions having a radius to allow at least the radially inwardly facing portions of the plurality of legs to pass through the plurality of first portions without interference;

a plurality of second portions extending radially outward from the plurality of first portions beyond the first radius; and a plurality of third portions having a radius less than the first radius and greater than the first distance.

18. The assembly of claim 17, further comprising:

a passage extending through the first portion and the disk such that the passage is aligned with the portion extending from the bottom surface of the splash plate; and, a screw disposed within the passage to fasten the splash plate to the support arm.

19. A method of assembling a cooling tower nozzle assembly, comprising:

providing a body having an opening extending through the body and a support arm extending from the body to support a disk in a position opposite the opening of the body;

providing a splash plate having a bottom surface including a plurality of legs extending away from the bottom surface, wherein the legs have radially inwardly facing portions spaced a first distance from a central axis of the splash plate and a plurality of radial recesses formed in the radially inwardly facing portions of the legs, wherein the plurality of radial recesses having a first radius;

aligning the plurality of legs with a plurality of first portions of the disk that have a radius that is less than the first distance;

bringing the splash plate and the disk together such that the plurality of legs pass through the plurality of first portions until the radial recesses are aligned with the disk;

rotating the splash plate with respect to the disk to engage a plurality of second portions of the disk with the plurality of legs, wherein each of the plurality of second portions have a radius that is greater than the first radius; and continuing to rotate the splash plate with respect to the disk such that respective third portions of the disk are disposed within radial recesses of the plurality of legs, wherein the third portions each have a radius that is less than the first radius and greater than the first distance.

20. The method of claim 19, further comprising:

securing the disk to the splash plate with a screw after the third portions are disposed in the radial recesses.

* * * * *